United States Patent [19]

Wymer et al.

[11] Patent Number: 4,823,708

[45] Date of Patent: Apr. 25, 1989

[54] METHOD FOR COVERING AN OPEN-TOPPED VEHICLE

[76] Inventors: Gary E. Wymer, 5915 W. 88th Terrace, Overland Park, Kans. 66207; H. Allen Salsbury, 8212 NW. Delta, Kansas City, Mo. 64151

[21] Appl. No.: 165,021

[22] Filed: Mar. 7, 1988

[51] Int. Cl.[4] ..... B61D 39/00

[52] U.S. Cl. ..... 105/377; 220/359; 53/442

[58] Field of Search ..... 105/377, 355; 296/100, 296/104; 220/359; 215/232; 383/101; 53/442, 478

[56] References Cited

U.S. PATENT DOCUMENTS

| | | | |
|---|---|---|---|
| 722,873 | 3/1903 | Mutch | 105/377 |
| 894,759 | 7/1908 | Stevens | 105/377 |
| 2,969,284 | 1/1961 | Ambli | 296/100 |
| 2,991,524 | 7/1961 | Dobrikin | 24/371 |
| 3,017,729 | 1/1962 | Cheeley | 53/478 |
| 3,041,104 | 6/1962 | Richard | 296/100 |
| 3,044,653 | 7/1962 | Tantlinger | 105/377 X |
| 3,330,225 | 7/1967 | Barry | 105/377 |
| 3,494,658 | 2/1970 | Maes, Jr. | 296/100 |
| 3,614,154 | 10/1971 | Evans | 296/100 |
| 3,628,720 | 12/1971 | Schmedding | 383/101 |
| 3,951,447 | 4/1976 | Sharp | 105/377 X |
| 4,018,337 | 4/1977 | Barnett | 53/442 X |
| 4,248,475 | 2/1981 | Johnsen | 296/100 |
| 4,625,654 | 12/1986 | Kuss et al. | 105/377 |
| 4,657,062 | 1/1987 | Tuerk | 160/243 |

FOREIGN PATENT DOCUMENTS

| | | | |
|---|---|---|---|
| 114087 | 11/1941 | Australia | 296/100 |
| 3036479 | 9/1982 | Fed. Rep. of Germany | 296/100 |
| 3999 | 12/1885 | United Kingdom | 105/377 |

*Primary Examiner*—Dennis H. Pedder
*Assistant Examiner*—F. Williams
*Attorney, Agent, or Firm*—Litman, McMahon & Brown

[57] ABSTRACT

A method of applying a cover to an open-topped vehicle, such as a freight vehicle, includes steps of applying a single-use covering which includes a cage having a standard length and adjustment elements for taking up the difference between the cage length and the length of the vehicle to the vehicle. The cage includes cover supporting ribs that are spaced apart from each other according to preset distances. The covering also includes a flexible cover that is shrinkable and self-weldable upon the application of heat thereto, and is attached to the vehicle by forming double-ply end joints by welding a first portion of the cover to a second portion of the cover to form a hem with a line located inside the hem. The line is attached to the vehicle. Patches can also be placed in locations on the cover needing multiply protection and heat welded to the cover at those locations.

10 Claims, 4 Drawing Sheets

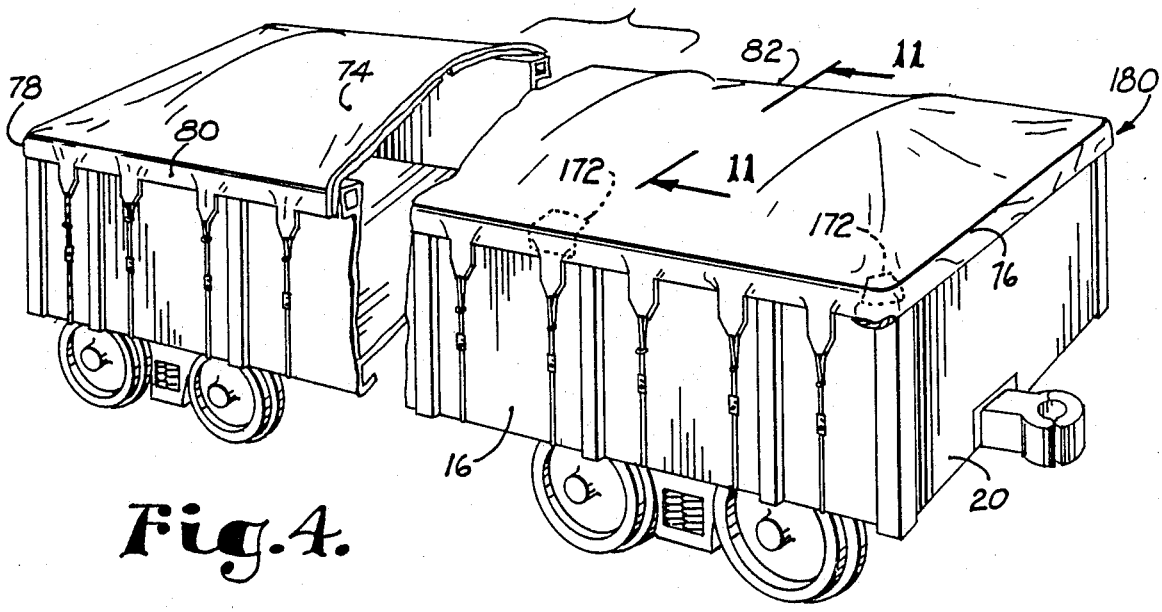
Fig. 4.
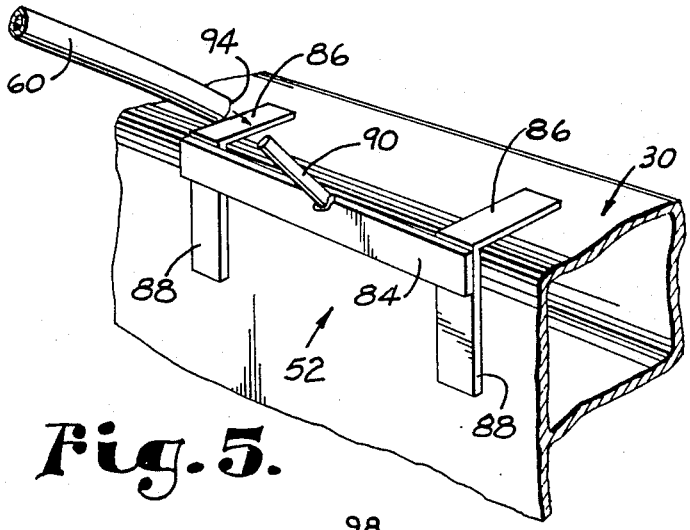
Fig. 5.
Fig. 9.
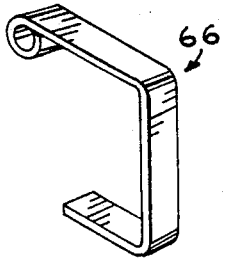
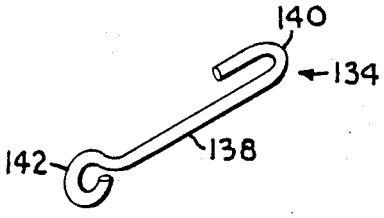
Fig. 10.
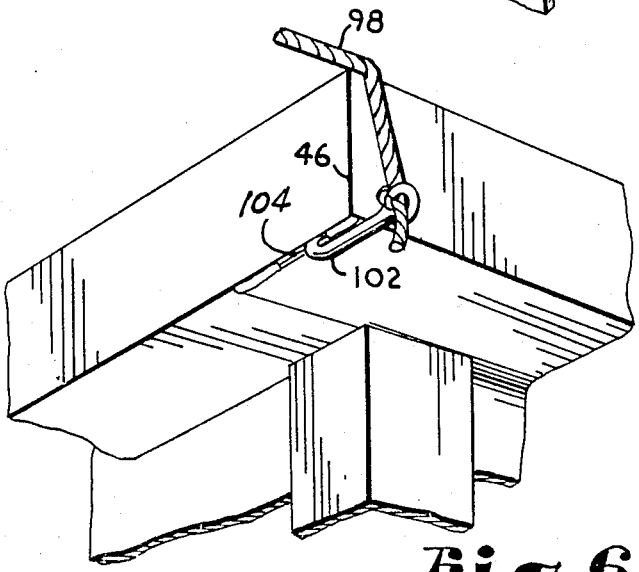
Fig. 6.

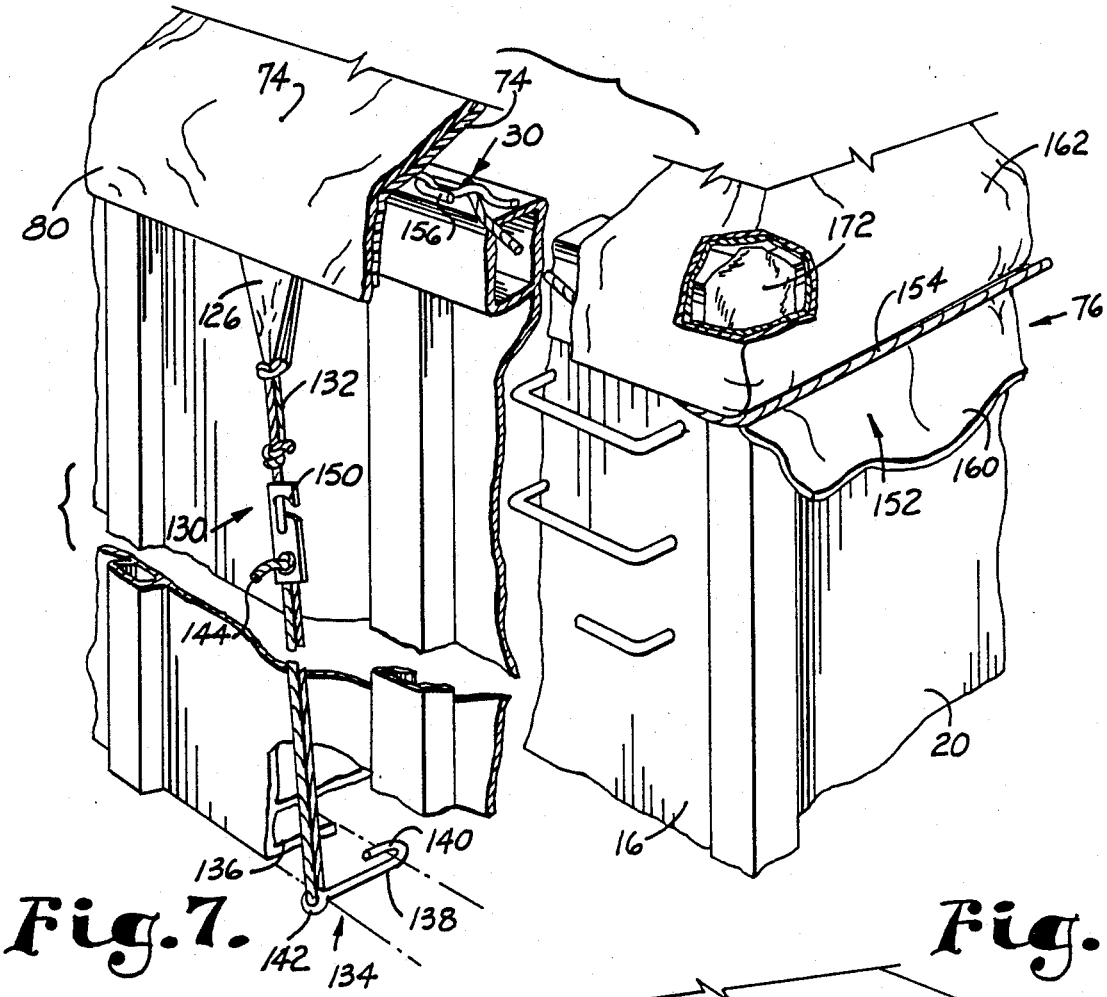
Fig.7.
Fig.8.
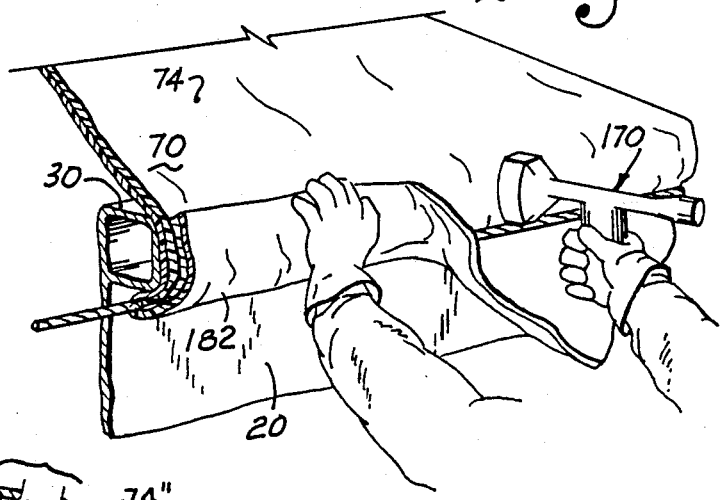
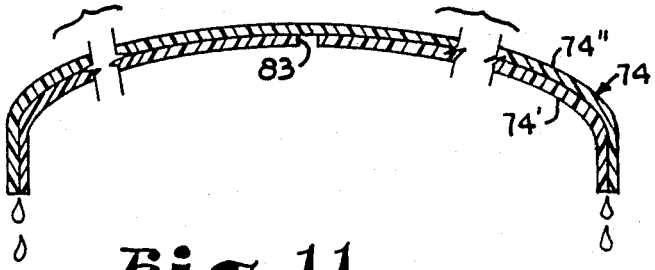
Fig.11.

METHOD FOR COVERING AN OPEN-TOPPED VEHICLE

BACKGROUND OF THE INVENTION

1. Field of the Invention

The present invention relates in general to covering open-topped vehicles, and in particular to covering open-topped freight vehicles. Specifically, the present invention relates to a method of covering open-topped freight vehicles in a secure, yet efficient manner.

2. Description of the Prior Art

In recent years, it has become desirable to ship materials such as grain, granular materials, and the like that are subject to degradation or spoilage if exposed to the weather. Even many scrap and metal products should not be exposed to weather during shipping. Some products, such as sand or the like, while not subject to damage from the weather are still best not exposed during shipping due to the possibility that such materials may fly off of the freight vehicle and become a nuisance. Crushed-rock ballast is commonly stored and transported by railroads in ballast cars with open tops and bottom dispensing hoppers. Ballast is used year-round for track bed repair, but in icing conditions the ballast can freeze into a solid, unusable mass.

Since, for many reasons, it is easy to ship materials, such as mentioned above, in open-topped freight vehicles, such vehicles have received Wide acceptance. However, due to the just-mentioned problems, as well as other requirements, such vehicles should be covered during the transportation of the material, and possibly also covered while the material is being stored in the vehicle if such storage is performed. Present open-topped freight vehicles come in many designs, and one example of such vehicles is the so-called gondola car. A gondola car is a flat-bottomed railroad car which has no top, fixed sides and often has removable ends, and is used to ship steel, rocks or heavy bulk commodities. Other examples of such open-topped vehicles include ballast cars, hopper cars and flat cars. Of course, other examples of such vehicles will occur to those skilled in the art based on the disclosure herein. Due to the possible variations in such vehicles, the dimensions of the vehicles can be subject to wide variations. In fact, vehicles of the same type, such as the just-mentioned gondola car, may have dimensions that vary among the vehicles of that same type. Thus, not all gondola cars have the same axial length, and so forth.

With regard to covering such vehicles, it is noted that many requirements exist. For example, the cover must be strong enough and mounted securely enough to resist coming off of the vehicle when subject to a strong wind as may occur during transit at high speeds, or as may occur if the vehicle encounters a strong wind storm. Such wind may find its way beneath the cover and thus lift it from the vehicle. Such strong wind may also tend to rip the cover and thus exacerbate the just-mentioned problem by establishing further paths for the wind to get beneath the cover.

However, these mounting and strength requirements are not easily satisfied as the cover must be mounted in place in an efficient manner, often in extremely harsh weather conditions. Thus, a cover that is made strong merely by having a great deal of material may not satisfy the total requirements as it may be expensive and also may be difficult to mount. Still further, a cover that is securely mounted may not satisfy the requirements of being efficient to mount in difficult weather conditions.

Basically, there are two choices when it comes to covering such open-topped vehicles (1) a permanently attached cover; and (2) a temporary cover, or cover that is basically designed to be a single-use cover. Each of these choices has its advantages and each has its own particular drawbacks.

For example, while a permanent cover has the advantage of being adapted to be "customized" for a particular vehicle, it has a drawback associated with being expensive due to "loss" of the cover. "Loss" can occur due to handling or due to general degradation as a result of exposure to harsh weather conditions. If a vehicle having a permanent cover thereon is stored after use in a manner that does not lend itself to further use of the vehicle to carry the material for which the cover is most effective, the covered vehicle might be considered as being "lost".

Accordingly, some of the advantages of the permanently covered vehicle, especially the economic advantages, which are gained by making multiple uses of a single piece of equipment are vitiated if not entirely lost due to the "loss" of the cover. In any case, if the cover is made strong and secure but must be expensive to build or to use in order to accomplish this result, it is not a totally successful design.

On the other hand, a single-use cover can overcome some of the above-mentioned drawbacks of the permanent cover. For example, such a single-use cover is not as subject to degradation due to weather, is not as subject to expense due to a lack of multiple uses, and is not as likely to have a design requirement for multiple and varied uses as is the permanently attached cover. Accordingly, some of the problems associated with permanent covers are overcome by the single-use cover. By its basic nature, a single-use cover is not subject to the above-mentioned drawbacks associated with "loss" of the cover.

However, in overcoming some problems, the single-use cover presents problems of its own.

For example, since a single-use cover is designed to be assembled each time it is used, therefore, any difficulties in assembly are magnified many times over those same difficulties associated with a permanently attached cover. Thus, time and ease of assembly become important considerations in single-use covers.

Still further, a single use cover is best sold as a kit to be stored and assembled as necessary. Thus, to be most effective, the single-use cover should be "universally adaptable". That is, the cover furnished in a single kit should be amenable for use on a variety of vehicle dimensions. If a single-use cover cannot be designed to be "universally" adaptable, many different single-use covers may be required to fit all of the different types of vehicles and even the different sized vehicles of the same type. A requirement for many different single-use cover kits may vitiate or even defeat many of the economic advantages of such a device as compared to a permanently mounted cover.

A permanently mounted cover can have the advantage of being designed especially for the vehicle upon which it is used to be securely mounted thereon and to be as strong as possible for that particular vehicle; whereas, a single-use cover sold in a kit may not be perfectly adapted to the particular vehicle being covered and some security in mounting and strength of the cover may be lost. Thus, again, universal use requires sacrificing some advantages associated with customizing of the cover to the particular vehicle.

Yet another drawback associated with single-use covers as compared to the permanently attached covers may be that of consistent results. That is, when a cover is permanently attached to a vehicle, yet has some limitations, the user of that vehicle is able to learn what those limitations are and can account for them in his planning. However, a single-use cover cannot generate such a history, so each cover may have its own particular quirks and problems which a user may not be able to account for in a preoccurrence manner.

Accordingly, there is a need for a method of mounting a single-use cover that can be quickly, yet securely mounted on a vehicle even under difficult weather conditions, yet is adaptable to a wide variety of vehicles and can be designed to be consistent and strong, and thereby realize many of the advantages of both a single-use cover as well as a permanently attached cover without being subject to all of the drawbacks associated with each of such cover designs.

OBJECTS OF THE INVENTION

It is a main object of the present invention to cover an open-topped vehicle in a secure manner.

It is another object of the present invention to provide a method of assembling and mounting a single-use cover on an open-topped vehicle in an efficient and secure manner.

It is another object of the present invention to provide a method of mounting a single-use cover on an open-topped vehicle in a manner that makes the cover amenable for use with a variety of different vehicle sizes.

It is another object of the present invention to provide a method of mounting a single-use cover on an open-topped vehicle in a manner that provides consistent design results.

It is a specific object of the present invention to provide a method of mounting a single-use cover on gondola, hopper and ballast cars.

It is another specific object of the present invention to provide a method of mounting a single-use cover on railroad cars that permits that cover to be efficiently installed even under severe weather conditions, and permits that cover to accomodate a variety of car dimensions yet will be securely mounted on the car.

It is another specific object of the present invention to provide a method of covering railroad cars with a cover that is strengthened in the particular locations most likely to be damaged during use of the cover, yet is not wasteful of cover material.

SUMMARY OF THE INVENTION

These, and other objects, are accomplished by the method of covering a vehicle embodying the present invention which comprises providing a cover supporting means that includes a cage that can be produced at a factory to include the most efficient design, yet can be modified to account for dimensional variations of individual vehicles with which it will be used and can still be efficiently and securely set up.

Specifically, the method of the present invention comprises providing a cage formed of a plurality of ribs mountable on the side walls of an open-topped vehicle, and a ridge line means for establishing a preset spacing between those ribs in the set-up configuration. The method further includes using an adjustment means for correcting the difference between the cage length and the length of the vehicle, and the method then includes a step of adjusting the covering means to accommodate a vehicle having an axial length different than the axial length of the cage.

In this manner, the spacing between ribs, and, indeed, the ribs themselves, can be designed at the factory to be the most efficient configuration, yet any variances caused by variations in vehicle dimensions can be accommodated. A "universal" single-use covering means is thus provided. Since the cover is designed at a factory, its properties and the design properties thereof are uniform and its results can be viewed as being repeatable and consistent.

Still further, the covering means used in the method of the present invention includes a double-ply, flexible cover that has properties that permit it to be shrinkable and self-weldable weldable by application of heat thereto, and is sized and shaped to form an overlapping flap on each end of the vehicle when the cover is placed on the cage when the method of the present invention is practiced. The covering means then includes end truss means that is associated with each end of the vehicle to tie the ends of the cover to the associated ends of the vehicle. Each truss means includes a line that will be positioned inside of a hem formed when the flap is folded back against the remainder of the cover. Since the cover is formed of material that is self-welding upon the application of heat, the application of heat to the thus formed hems will form a multi-ply joint at both ends of the vehicle. Some of the material from a flap can be removed and located over the corners of the vehicle, or any other location that may require extra reinforcement, and then heat welded in place to form multi-ply areas.

In this manner, those areas of the cover that are most likely to receive harsh treatment during use of the cover are reinforced by formation of multi-ply areas. This permits strengthening of the cover only in those areas and does not require the entire cover to be strengthened. Specifically, since the end joints are likely to encounter harsh wind conditions, this multi-ply configuration is most beneficial. The joint is continuous over essentially the entire width of the vehicle, and thus is not subject to the problems associated with attachment means, such as clamps, that only cover a limited portion of the area while leaving gaps between the attachment means. In this manner, the force exerted on the end of the cover is distributed throughout the multi-ply joint rather than on concentrated areas.

BRIEF DESCRIPTION OF THE DRAWINGS

FIG. 4 is a perspective showing the covering means of the present invention in place on a freight vehicle.

FIG. 5 is a perspective of a rib supporting bracket and a portion of a cover supporting rib used in the covering means of the present invention.

FIG. 6 is a perspective of an attachment means used in conjunction with the covering means of the present invention.

FIG. 7 is a perspective showing a side attachment means and an end attachment means for the covering means.

FIG. 8 is a perspective showing the formation of a multi-ply end joint for the covering means.

FIG. 9 is a perspective showing a C hook.

FIG. 10 is a perspective showing a GS hook.

FIG. 11 is a fragmentary, vertical cross-section taken generally along lines 11—11 in FIG. 4 and particularly shows a cover condensation opening.

DETAILED DESCRIPTION OF THE PREFERRED EMBODIMENTS

As required detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
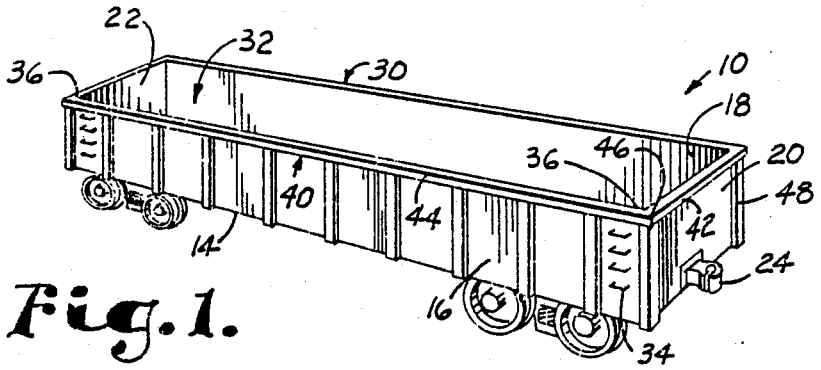
FIG. 1 is a perspective of an open topped freight vehicle such as is covered by the covering means embodying the present invention.

Shown in FIG. 1 is an open-topped vehicle 10 of the type used to store and ship freight. Examples of such open-topped vehicles are: gondola cars, flat cars, ballast cars, and hopper cars. However, other forms of such cars will occur to those skilled in the art, and accordingly, the present invention is not intended to be limited to the specific listing of open-topped vehicles just mentioned, but is applicable to any such open-topped vehicle.

Specifically, the open-topped vehicle 10 inherently includes a wheeled base 14 supporting upstanding side walls 16, 18 and upstanding end walls 20, 22. Couplings, such as coupling 24, are mounted on the end walls 20, 22 in the manner usual to such vehicles. The end walls 20, 22 and side walls 16, 18 terminate in a co-planar manner to form a top rim, such as indicated by the reference numeral 30 in FIG. 1. The walls 16, 18, 20 and 22 and base 14 of the vehicle 10 thus form a container volume, indicated generally by the reference numeral 32 in FIG. 1, and the usual ladders 34 and other such equipment are included on the vehicle 10. The ladders 34 are located adjacent to the corners, such as corner 36 formed by the intersection of side wall 16 and end wall 20. As shown in FIG. 1, the top rim 30 can include an overhang means 40 formed by end rim elements 42 and side rim elements 44 which intersect each other to form rim corners, such as rim corner 46. Corner and side wall reinforcement elements 48, 49 can also be included as necessary.

Figure 2:
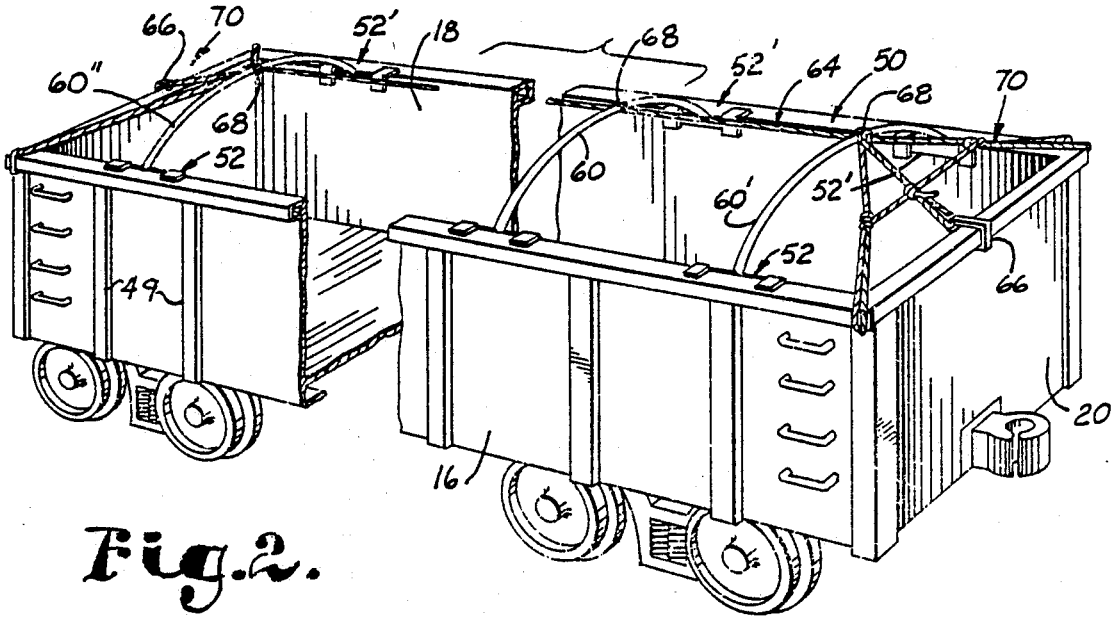
FIG. 2 is a perspective showing a cage of the covering means mounted on the freight vehicle.

Having described the general nature of the open-topped vehicle 10, reference is now made to FIG. 2 for a description of the cover means for such a vehicle as embodied in the present invention.

The cover means includes a cover supporting cage 50 of a standard length. This standard length is set according to the needs of the freight shipping industry and is uniform for each covering means. The cage 50 includes a plurality of side wall mountable ib supporting brackets, such as bracket 52, which are mounted on the side walls 16, 18 of the vehicle to form cooperative pairs. That is, each rib supporting bracket 52 on side wall 16 has a corresponding rib supporting bracket 52′ on the side wall 18. The rib supporting brackets 52, 52′ will be discussed in greater detail below.

The cover supporting cage 50 further includes a plurality of cover supporting ribs 60 each of which is spaced apart from adjacent ribs 60 along the axial length of the vehicle as measured between the end walls 20, 22. The spacing between the adjacent cover supporting ribs is preset at the factory to form a cover supporting cage 50 having the characteristics desired for best results in covering materials and the like commonly carried in open-topped vehicles. The ribs are preferably lengthwise arcuate and are sized to extend across the width of the vehicle as measured between the sides 16, 18. The cover supporting ribs are attached to the rib mounting brackets 52, and will be discussed in greater detail below.

The cover supporting means cage 50 further includes a ridge line means 64 which extends axially along the vehicle from end wall 20 to end wall 22 and is attached to those ends by attaching means, such as C hook 66, which may be bent into shape from a flat strip of metal (FIG. 9). The ridge line means 64 includes a plurality of rib attaching means 68 comprising knots for attaching the cover supporting ribs 60 thereto. In fact, the ribs are attached to the ridge line means at the factory, and thus, the ribs 60 could be considered as being part of the ridge line means 64. The rib attaching means are spaced apart along the axial length of the ridge line means, and are spaced apart by distances that are preselected to space the cover supporting ribs 60 apart from each other by the aforediscussed preset spacing. Thus, setting up the cage 50 with a spacing between cover supporting ribs that is equal to the design spacing is a simple matter as the ridge line means 64 can be used as a guide for such spacing. This feature will be more fully evident from the ensuing discussion. Most preferably, the ridge line means 64 is a rope-like element.

Accordingly, the cage means 50 is seen to include the rib supporting brackets 52, the ribs 60 and the ridge line means 64 to which the ribs are attached at preset spacings to define the standard length of the cage means.

The cover supporting means of the present invention further includes an adjustment and cover supporting means 70 adapted to connect each end of the cage to an associated end of the vehicle. Each adjustment and cover supporting means 70 is adjustable and connects the endmost rib, such as rib 60′, of the cage 50 to the end of the vehicle which is adjacent thereto in a manner which accounts for differences between the overall length of the cover supporting cage 50 as measured between endmost rib 60′ and the corresponding endmost rib 60″ on the end of the cage remote from endmost rib 60′ and the overall axial length o the vehicle. As many vehicles may have axial lengths which are different from other vehicles, and since the overall length of the cage 50 is standard, there should be some means for accounting for such variations so a standardized cover supporting cage can be used in a universal manner. The adjustment and cover supporting means serves this purpose. The adjustment and cover supporting means 70 is adjustable to be adapted to connect an endmost rib to the adjacent end of the vehicle in a manner that can vary from vehicle to vehicle so that the standard overall length of the cage can be used with all vehicle lengths. The adjustment and cover supporting means 70 will be more fully discussed below.

The covering means further includes a double-ply flexible cover 74 with inner and outer layers 74′, 74″, which are formed of a material (e.g. polyethylene) that permits the flexible cover 74 to be shrinkable and self-weldable upon the application of heat thereto. Such a cover is sold under the trademark TRAK PAK by the assignee of the present invention. The flexible cover 74 includes ends 76, 78 and sides 80, 82. The cover inner layer 74, includes a condensation opening 83 (FIG. 11). Under certain operating conditions, moisture from a cargo in the vehicle 10 will cause relatively high humidity levels in the air trapped by the cover 74. The moisture-laden air can escape through the condensation opening 83, condense on the inner surface of the cover outer layer 74'', and trickle between the cover layers 74' and 74'' to the cover ends 76, 78 and sides 80, 82 for discharge. In transit, the air movement over the cover outer layer 74'' will, of course, lower its temperature and correspondingly increase the rate of condensation due to the temperature differential between the cooler cover outer layer 74'' and the warmer, moist air trapped thereunder. Thus, the cover 74 cooperates with the vehicle 10 to actually "dry" a cargo in transit. The ends of the flexible cover are adapted to correspond to the ends of the vehicle and the sides of the flexible cover are adapted to correspond to the sides of the vehicle. The flexible cover 74 will be more fully discussed below.

Referring next to FIG. 5, the rib supporting brackets 52 will be discussed in detail. As shown in FIG. 5, each bracket 52 includes an elongate base 84 with vehicle rim engaging legs 86 on each end of the base and vehicle side engaging legs 88 on each end of the base at locations corresponding to the locations of the rim engaging legs 86. If suitable, the side engaging legs 88 are longer than the rim engaging legs 86 to form a solid base for each bracket. Each bracket 52 further includes an arcuate rib engaging projection 90 mounted on the base 84 between the legs thereof to extend upwardly above the rim and toward the other side wall when the bracket is mounted on one of the side walls. The rib supporting brackets 52 are adapted to rest on the vehicle rim 30 with the side engaging legs 88 resting against the inner surface of the vehicle side walls. In this manner, the brackets can be easily set onto the vehicle and easily moved to accommodate the cage 50, yet will be securely mounted in place upon the in situ erection of the cage due to the downward and outward pressure exerted on the base 84 by the weight of the flexible cover and cover supporting rib 60 attached thereto as will be evident from the following discussion.

As is also shown in FIG. 5, the cover supporting ribs 60 are hollow adjacent to the ends 94 thereof. The hollow ends 92 of the ribs 60 are adapted to receive the arcuate rib engaging projections 90 to removably mount the ribs 60 onto each bracket 52. In this manner, the ribs 60 are quickly, yet securely mounted onto the vehicle via the brackets 52. The mounting of the brackets 52 onto the vehicle and the mounting of the ribs 60 to the brackets are such that the cage 50 can be quickly assembled in situ and can be quickly disassembled whereby the cover means of the present invention is a single-use cover for the vehicle.

Figure 3:
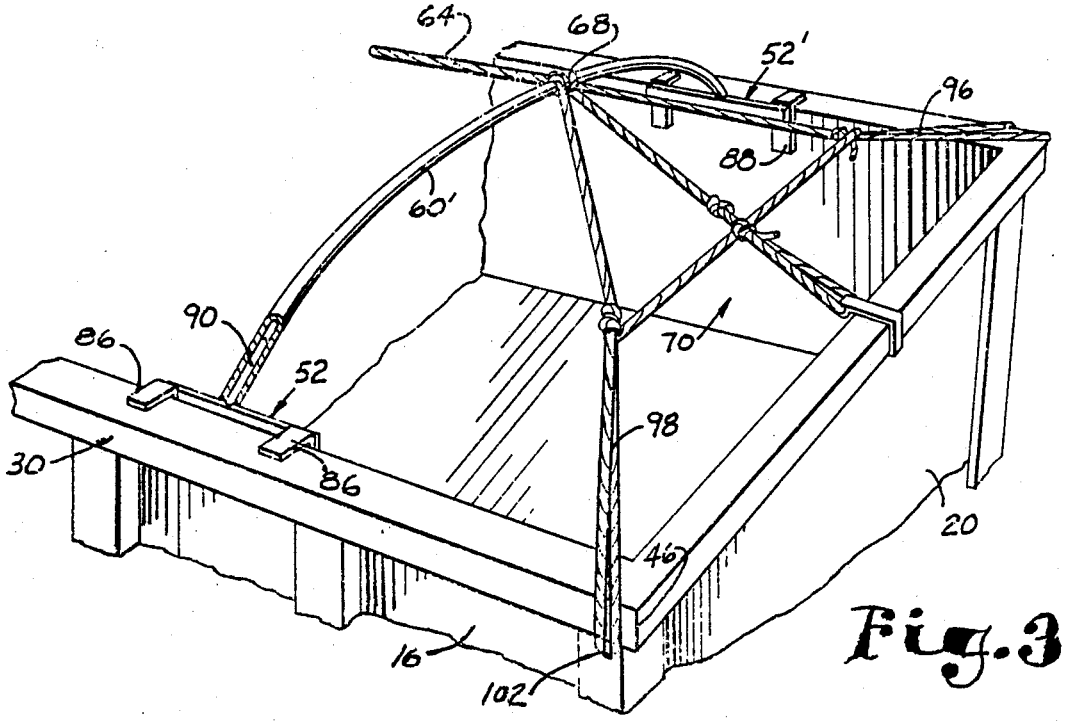
FIG. 3 is a perspective of an end adjustment and cover supporting means of the covering means of the present invention.

The adjustment and cover supporting means 70 is best shown in FIG. 3, and attention is now directed to such figure. As shown in FIG. 3, the adjustment and cover supporting means 70 includes a pair of corner tether lines 96, 98, each of which is attached at one end thereof to the endmost rib 60' or 60'' adjacent to the ridge line means rib attaching means (knots) 68 and has the other end thereof removably attached to the vehicle rim 30 adjacent to the corners thereof, such as rim corner 46. The attachment of the tether lines to the vehicle is preferably by means of hooks, such as bent wire GS hooks 102 (FIG. 10) which attach to the underside of the rim (see, e.g., FIG. 6 and FIG. 7 for two forms of attachment between GS hooks and the vehicle). If the FIG. 6 form of GS hook is used, the rim 30 will include openings, such as opening 104, defined therein adjacent to the rim corners. It is noted that the hooks should not be attached to the ladders 34 as such element may be a safety hazard on a ladder.

The tether lines 96, 98 can be intertwined with each other and attached to the hook 66 of the ridge line means 64 as necessary to define a taut network of lines between the endmost cover supporting rib 60' or 60'' and the end of the vehicle. The intertwining can be effected by merely looping the lines together, or by forming knots at the intersections of the lines.

Alternatively, an additional tether line can be included. In such case, the tether lines 96, 98 are attached to the endmost cover supporting rib and to the rim of the vehicle, and the additional tether line is knotted around these two tether lines at a location between the endmost cover supporting rib and the hook 66 and is attached to the hook 66 to form a sort of triangle support. The additional tether line can be pulled as necessary to position the attachment thereof to the tether lines 96, 98 as needed to set the adjustment and cover supporting means 70 to account for the dimensional variations of the vehicle with respect to the standard cage dimensions.

At any rate, the tether lines 96, 8 are attached to the endmost rib and to the hook 66 and to the vehicle in a manner to tightly connect the endmost rib to the vehicle and to stretch out the ridge line means 64 to set up the cage 50 on a vehicle that has an axial length that is different from the axial length of the cage as measured between the endmost ribs 60' and 60''.

The flexible cover 74 is shown in FIG. 7 and includes ends, such as end 76, and sides, such as side 80. A plurality of lobar elements 126 are integrally attached to the cover at the spaced-apart locations along the sides thereof. Preferably, the cover is monolithic, and is sized to be longer, as measured between its ends, than the axial length of the longest vehicle with which it will be used, and to have a width, as measured between its sides, that is wider than the width of the widest vehicle with which it will be used. The cover will thus initially have an overlap on both the sides and the ends of the vehicle as indicated in FIG. 7. This overlap will be taken up when the cover is placed in position on the vehicle as will be more fully discussed below. The cover is placed on top of the cage 50 and on top of the adjustment and cover supporting means 70 after these two systems have been set up on the vehicle. The manner of placing the cover on these systems will be more fully discussed below.

Each of the lobar elements 126 is attached to the vehicle by a cinching means 130. Each cinching means 130 includes a tie line 132 connected to the lobar element and to a hook 134. The hooks 134 are attached to a lower rim 136 of the vehicle, and can be GS hooks 102 which include a body 138 and a hairpin end 140 on one end and a line attaching eye 142 on the other end thereof (FIG. 10). The tie lines 132 are threaded through the hook eyes and have an end 144 which is attached to a tie-down line connector 150. The tie-down line connector 150 functions in the manner of a turnbuckle to tighten the line holding the cover to the vehicle. It is noted that the tie line 132 can be attached to the lobar element 126, to the hook 134 and to the connector 150 in any suitable manner, and the knots located and shown in FIG. 7 are merely examples of such connection.

The ends of the cover are attached to the vehicle adjacent to the ends of the vehicle in a manner that is both efficient and secure. Referring to FIGS. 7 and 8, it can be seen that the attachment between the end of the cover and the end of the vehicle includes a truss means 152 having a line 154 extending around the end of the vehicle and attached at each end thereof to the sides of the vehicle adjacent to the corners 46 of the rim by hooks, such as hook 156 shown in FIG. 7. The line 154 extends over the end of the cover as shown in FIG. 7 to form a tail 160 extending beneath the truss line 154 and a cover body 162 extending above the truss line 154.

A multi-ply joint 180 is formed at each end of the cover by turning the tail 160 over the truss line and attaching it to the body 162 adjacent to the truss line to form a hem 182 with the truss line inside that hem as indicated in FIG. 8.

The upturned tail 160 is welded to the body 162 by the application of heat to the folded up tail.

The multi-ply in situ formed joint thus formed will be essentially continuous and monolithic across essentially the entire width of the vehicle, and thus will be stronger than attachments that are point attachments. It is noted that the sides of the cover can be attached by point attachments formed by the side attaching means as the wind is not as likely to damage the vehicle from the side since the vehicle is generally moving with one of its ends into the wind.

This application of heat can also be carried out in a manner that serves to shrink the cover against the cinching means to take up looseness in the cover which results because the cover is deliberately sized larger than the vehicle to make the cover universal in nature. Heat can be applied by means of a hand-held heat gun, such as a propane-fueled heat gun 170 shown in FIG. 8. However, other heat generating means can also be used without departing from the scope of the present invention. A formed multi-ply joint 180 is shown in FIG. 4 to be located adjacent to the vehicle end 20, and it is noted that a multi-ply joint is also formed adjacent to the vehicle end 22.

Patches, such as corner patch 172 shown in FIG. 4, can be formed in situ by removing pieces of the cover tail prior to heat sealing that tail to the cover body, and heat sealing those patches to the cover adjacent to the rim corners, or to any other suitable location on the cover by means of the heat gun. In fact, the multi-ply joints 180 can also be further reinforced by such patches if suitable. These patches, corner or otherwise, thus form a multi-ply thickness for the cover at locations deemed to be in need of reinforcement.

The fully formed and set up cover is shown in FIG. 4 on the vehicle. As seen in FIG. 4, the cover is tightly set on the vehicle, and includes double and multi-ply areas. Yet, the cover is easily set up and taken off of the vehicle.

Figure 12:
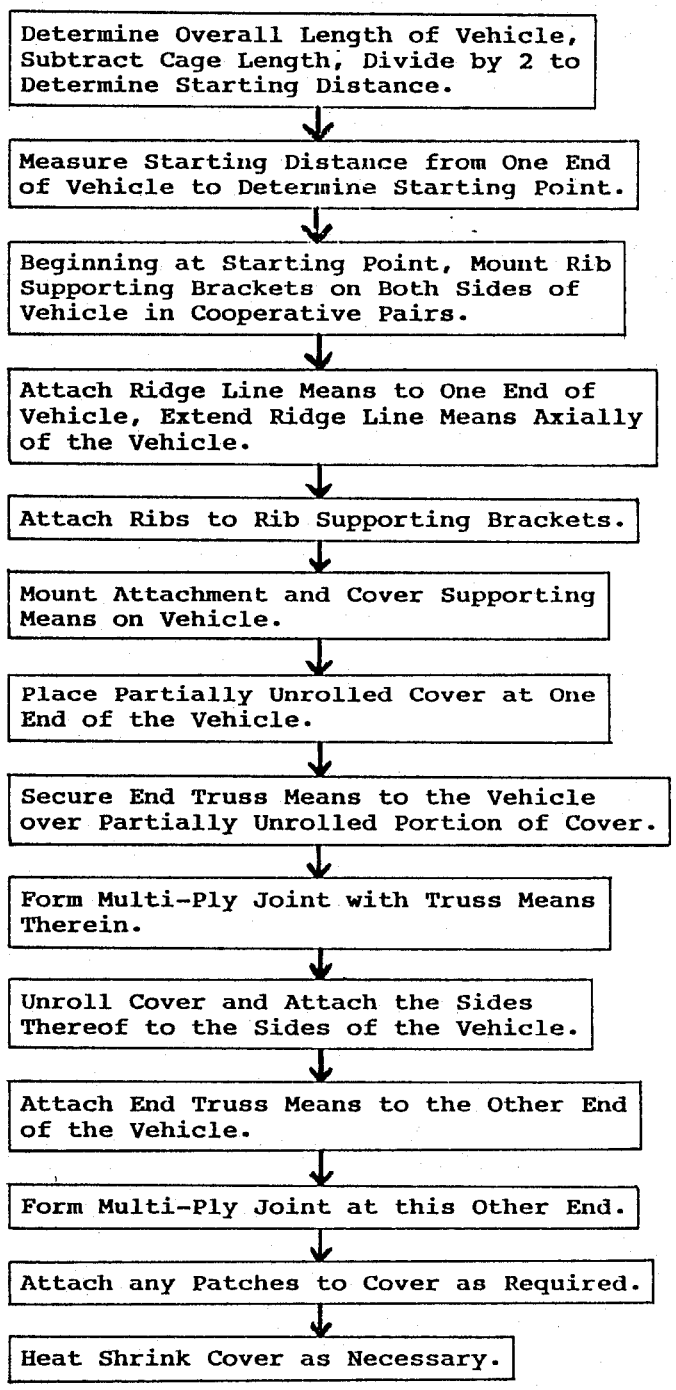
FIG. 12 is a flow chart showing the various steps included in the method embodying the present invention.

Referring next to FIG. 12, the method of setting up the cover means according to the present invention will be discussed. The first step in carrying out the method of the present invention is to determine the overall axial length of the vehicle 10 and subtracting from such overall axial length dimension the overall axial length of the cage 50 as measured between the endmost cover supporting ribs 60', 60''. The overall length of the cage will be given on the package containing the vehicle covering kit. This difference is then divided by two to determine the initial spacing for the cage. This initial spacing is measured from one end of the vehicle and a starting point for placement of the first rib supporting bracket 52 is thus defined. The remaining rib supporting brackets are then placed on the vehicle walls in cooperative pairs. The brackets are now ready to receive the cover supporting ribs.

The cover supporting ribs are attached to the ridge line means 64 at spacings along that ridge line means that are preset at the factory for the most effective results. The ridge line means therefore is attached to one end of the vehicle, stretched out and attached to the other end of the vehicle. This ridge line means has the cover supporting ribs attached thereto at preset spacings, and the thus spaced cover supporting ribs are attached to the rib supporting brackets, which can be moved as required to accomodate the cover supporting ribs.

The adjustment and cover supporting means 70 at each end of the vehicle is then set up to account for any discrepancies between the cage overall length and the vehicle overall length. This means 70 is then tied and shortened as required to accomplish this result.

The cage and cover support are thus set up in situ.

The flexible cover 110 is then unrolled to have one end thereof overlap one end of the vehicle.

The end truss means 152 associated with that one vehicle end is set up to have the line 154 tightly attached to the vehicle and to extend over the end of the cover to form the tail 160. The multi-ply end joint 170 associated with that one vehicle end is formed by folding the cover tail over the truss line 154 and against the body 162 of the cover to form a hem with the line 154 inside, and applying heat to the folded over joint to weld the tail to the cover body. It is noted that one method of welding the cover tail to the cover body includes heating the cover tail until it is almost to the melting point, then placing that heated tail on top of the cover body, then pressing the thus heated tail against the cover body as required.

The cover is then urolled over the cage and the other adjustment and cover attaching means. The sides of the cover are attached to the vehicle via the side cinch means 130 as the cover is being unrolled.

When the other end of the vehicle is reached, the cover is unrolled over that other end to form a tail at that end. The end truss means associated with that other vehicle end is formed, and the multi-ply joint associated with that other end is formed as above discussed.

Patches can also be made and applied as required by cutting off portions of either tail and applying such portions where needed, and then welding such patches to the cover by applying heat as needed and as above discussed.

If necessary, heat can be applied to the attached cover at selected locations to shrink it as required to establish a tight, secure fit between the cover and the vehicle.

The cover is removed by removing one of the end truss means, and removing the cover in a process that reverses the above discussed process. That is, the end of the cover is released from the end wall of the vehicle, the sides of the cover are released from the side walls of the vehicle, and the cover is rolled up (or simply pulled off of the vehicle if suitable), and then removed from the other end of the vehicle. The cage and adjustment means are then removed. The mounting brackets are then removed.

It is to be understood that while certain forms of the present invention have been illustrated and described herein, it is not to be limited to the specific forms or arrangement of parts described and shown.

What is claimed and desired to be secured by Letters Patent is as follows:

1. A method of removably covering a normally open-topped vehicle which has side walls and end walls, which comprises the steps of:

(a) removably mounting a plurality of rib supporting brackets on each of the vehicle side walls to form a plurality of cooperative bracket pairs;

(b) attaching a plurality of cover supporting ribs to respective said bracket pairs to extend across the width of the vehicle between the vehicle side walls and to form a cage on the vehicle;

(c) providing a flexible ridge line means and presetting a spacing between adjacent cover supporting ribs and axially supporting, longitudinally of said vehicle, said ribs by fixedly attaching said ridge line means to each rib with a rib attaching means;

(d) attaching said ridge line means to said vehicle ends;

(e) providing a flexible cover for covering the vehicle, the flexible cover being formed of a material having ends and sides;

(f) placing the flexible cover on top of the cage; and (g) attaching at least one end of the flexible cover to an end wall of the vehicle.

2. The covering method defined in claim 1, which further includes the step of providing an adjustment and cover supporting means attached to each end wall of the vehicle, each of said adjustment and cover supporting means being connected to said ridge line means and to an end rib of said cover supporting ribs for setting a distance between said end rib and the adjacent end wall of the vehicle, which distance corresponds to a predetermined portion of a difference between an overall axial length of the vehicle and a distance existing between said end rib and an end rib located adjacent to the other vehicle end wall whereby variations in vehicle axial length are taken up by said adjustment and cover supporting means so that the preset spacing between ribs is amenable for use on a wide variety of vehicles.

3. The method defined in claim 1 further including a step of adjusting the location of the cover supporting ribs on the vehicle to account for a difference between an axial length of the vehicle and an axial length of the cage whereby variations in vehicle axial length are accounted for so that said preset spacing between adjacent cover supporting ribs is amenable to a wide variety of vehicles.

4. The method defined in claim 1 further including a step of attaching said one end of said flexible cover to an end wall of the vehicle using an end truss means.

5. The method defined in claim 4 further including a step of forming a multi-ply joint for attaching the flexible cover one end to the end truss means by extending the flexible cover beyond the end truss means to form a flap and a body with respect to the end truss means and folding that cover back on itself with the end truss means positioned between the flap and the body and then applying heat to the folded back portion of the cover to weld the flap to the body.

6. The method defined in claim 1 further including a step of providing said flexible cover with inner and outer layers.

7. The method defined in claim 6 further including a step of forming a condensation opening in said cover inner layer.

8. The method defined in claim 1 further including a step of applying heat to said flexible cover.

9. The method defined in claim 8 further including steps of shrinking and self-welding said flexible cover.

10. A method of covering a normally open-topped vehicle which has side walls and end walls and which is subject to having a variety of axial lengths as measured between the end walls thereof, which comprises the steps of:

(a) mounting a plurality of rib supporting brackets which are adapted to be longitudinally movable on the side walls of the vehicle to form a plurality of cooperative bracket pair;

(b) providing a plurality of cover supporting ribs each of which is sized to extend across the vehicle from one vehicle side wall to another vehicle side wall and each of which includes opposite ends;

(c) attaching said opposite ends of each said rib to a respective cooperative pair of said brackets;

(d) forming a cover supporting cage on the vehicle with said cover supporting ribs and said rib supporting brackets, which cage has a predetermined axial length measured with respect to the axial length of the vehicle;

(e) providing a flexible ridge line means having ends and a plurality of rib attaching means;

(f) fixedly attaching said flexible ridge line means to said ribs with said rib attaching means at predetermined intervals and establishing preset spacings between adjacent ribs with said predetermined intervals;

(g) providing an adjustment and cover supporting means having means for setting a distance between an end rib of said cover supporting ribs and an end wall of the vehicle which distance corresponds to a predetermined portion of the difference between the overall axial length of the vehicle and the axial length of said cage whereby variations in vehicle axial length can be accounted for by said adjustment and cover supporting means so that the preset spacings between adjacent ribs is amenable for use on a wide variety of vehicles;

(h) providing a flexible cover having ends and sides;

(i) providing cover attachment means including end truss means;

(j) attaching said flexible cover to the vehicle with said cover attachment means and attaching said cover ends to the vehicle end walls with said end truss means;

(k) providing said flexible cover with a flap and folding said flap back upon itself with an end truss means captured therein and thereby forming a double-ply joint with said end truss means inside; and (l) applying heat to said flexible cover to thereby weld and shrink said flexible cover to said cover attachment means, including applying heat to said flap to thereby weld the flap to the remainder of the flexible cover.

* * * * *